US006371851B1

(12) United States Patent
Singer et al.

(10) Patent No.: US 6,371,851 B1
(45) Date of Patent: Apr. 16, 2002

(54) EXTENDED HAND MODIFIED VIDEO POKER GAME SYSTEM AND METHOD OF PLAYING THE SAME

(75) Inventors: Anthony M. Singer, Ringwood, NJ (US); Howard M. Marks, Westport, CT (US)

(73) Assignee: PTT, LLC, Nanuet, NY (US)

( * ) Notice: Subject to any disclaimer, the term of this patent is extended or adjusted under 35 U.S.C. 154(b) by 0 days.

(21) Appl. No.: 09/234,098

(22) Filed: Jan. 19, 1999

Related U.S. Application Data

(63) Continuation of application No. PCT/US98/10373, filed on May 21, 1998.
(60) Provisional application No. 60/047,493, filed on May 23, 1997.

(51) Int. Cl.[7] ..... A63F 9/24
(52) U.S. Cl. ..... 463/13; 273/292
(58) Field of Search ..... 463/13, 12; 273/292

(56) References Cited

U.S. PATENT DOCUMENTS

| | | | | |
|---|---|---|---|---|
| 4,743,022 A | | 5/1988 | Wood | |
| 4,948,134 A | | 8/1990 | Suttle et al. | |
| 5,013,049 A | | 5/1991 | Tomaszewski | |
| 5,019,973 A | | 5/1991 | Wilcox et al. | |
| 5,033,744 A | * | 7/1991 | Bridgeman et al. | 463/13 |
| 5,100,137 A | | 3/1992 | Fulton | |
| 5,118,109 A | | 6/1992 | Gumina | |
| 5,255,915 A | | 10/1993 | Miller | |
| 5,294,128 A | | 3/1994 | Marquez | |
| 5,314,194 A | | 5/1994 | Wolf | |
| 5,382,025 A | | 1/1995 | Sklansky et al. | |
| 5,401,023 A | * | 3/1995 | Wood | 463/13 |
| 5,407,199 A | | 4/1995 | Gumina | |
| 5,415,404 A | | 5/1995 | Joshi et al. | |
| 5,431,407 A | | 7/1995 | Hofberg et al. | |
| 5,437,451 A | | 8/1995 | Fulton | |
| 5,630,753 A | * | 5/1997 | Fuchs | 463/13 |
| 5,882,259 A | * | 3/1999 | Holmes, Jr. et al. | 463/13 |

* cited by examiner

*Primary Examiner*—Michael O'Neill
(74) *Attorney, Agent, or Firm*—Irah H. Donner, Esq.; Hale and Dorr LLP

(57) ABSTRACT

A video poker game method and apparatus for extending the play of a hand of poker includes optionally initializing a credit tally, and optionally determining whether a sufficient wager has been deposited before starting a round of video poker. The game includes associating the deposited wager with a respective payoff table from which the payoff for the chosen payable subset is obtained. At the beginning of a round of the modified poker game, the game includes dealing, for example, five playing cards from at least one deck of cards. The game includes determining payable subsets of the playing cards. The game includes ending the round of modified poker, if payable subsets do not exist. The game includes displaying, some or all, of the payable subsets, if payable subsets exist. The game includes determining which of the displayed payable subsets is chosen by a user, and adding a payoff associated with the chosen payable subset to the credit tally. The game further includes replacing the cards in the chosen payable subset with an equal number of playing cards, and cycling back to determine whether any additional payable subsets exist.

31 Claims, 10 Drawing Sheets

EXTENDED HAND MODIFIED VIDEO POKER GAME SYSTEM AND METHOD OF PLAYING THE SAME

RELATED APPLICATION

This application is a continuation application of International Application No. PCT/US98/10373 filed May 21, 1998 which in turn claims priority to U.S. Provisional Application No. 60/047,493 filed May 23, 1997, both of which are incorporated herein by reference.

TECHNICAL FIELD

The present invention relates generally to modified poker card games, and more particularly, to an apparatus, computer tangible medium storing computer-executable instructions, and a method of playing an extended hand modified video poker game.

BACKGROUND ART

The state gaming control boards of Nevada and New Jersey (which have traditionally been slow to approve any new games or gambling concepts) have changed their philosophy so dramatically that, today, they actively encourage the trial and acceptance of new games and gambling concepts. The problem with introducing new games has always been the basic criteria for mass-market gambling:

Game rules must be easy to learn.

Strategies must be easy to master and not favor "the expert" disproportionately.

Games must have a short duration between the start (the bet) and the finish (the payoff).

The payoff structure, that is, what can be won by a lucky player, must be enticing.

The game must be fair; the casino should not have an unreasonable advantage.

The game must be "secure," that is, protected from cheating and tampering.

The casino's "win" must be demonstrated to be worthwhile, that is, the "win per machine per month" must at least compare favorably to that of the "slots."

Over the years, there have been many different types of games that have attempted to satisfy the demands of the gaming industry. These games have ranged the gamut from those involving great mental prowess to games involving merely chance. Nevertheless, there is still a strong interest in games that create real excitement.

One such game is poker, a mainstay in the gambling world. Traditional five or seven card poker often uses the following rank order of winning hands from highest to lowest: royal flush, straight flush, four of a kind, full house, flush, straight, three of a kind, two pair, and "Jacks or better." Typically, more than one player are each dealt a poker hand by one player who acts as the dealer. The player with the highest hand according to the established rank order wins.

"STUD" poker, one variation of five card poker, provides each player with five cards, forming a hand. If the players are separately playing against the dealer, naturally, each player attempts to beat the dealer or to obtain one of a predetermined collection of winning hands, such as those in the above-mentioned rank order. Often, a payoff for a given winning hand is inversely proportional to the probability of attaining that hand.

The disadvantage of "STUD" poker is that each player must single-handedly ascertain each and every possible winning card combination, not to mention its associated payoff. Also, there is no opportunity to improve on a hand that has been dealt. Further, a poker hand, once it has been played has no bearing on a subsequent poker hand. Consequently, no continuous strategy need be or may be developed across a number of hands.

"DRAW" poker permits a player to make a single discard, whereby one or more of the cards selected by the player are replaced by the dealer. A discard provides an opportunity to the player to increase the value of his hand. Typically, only one discard per round is permitted. Plainly, "DRAW" poker increases the probability of obtaining a winning hand. To offset the probability of an improved hand, often the dealer reduces the payoff for any such wining hand by a constant amount.

However, like "STUD" poker, a disadvantage to "DRAW" poker is that the player must single-handedly ascertain each and every possible winning card combination and its associated payoff. Also, any one poker hand has no effect on a subsequent poker hand. Thus, as in "STUD" poker, a "DRAW" poker player need not develop a strategy to be implemented over the play of more than one hand.

U.S. Pat. No. 5,294,128, incorporated herein by reference, discloses a method of playing Hi-Hi-Lo Poker. A player is dealt six cards and must divide them into a one-card high ranking hand, a two-card high ranking hand, and a three-card low ranking hand. The player may submit a wager for each of the three hands. The player's one-card, two-card, and three-card hands are compared against a bank player's respective one-card, two-card, and three-card hands. Like "STUD" poker, the player is not permitted to discard any of the six dealt cards. Like "STUD" poker and "DRAW" poker, any one round of three hands has no relation to the outcome of a subsequent round of three hands.

Recently, electronic video poker gaming devices have been developed, placing traditional "STUD" poker and "DRAW" poker in an exciting multimedia environment. Various attempts have been made to enhance play of poker in the new environment over the years. Examples of such attempts are described in the following U.S. patent references, all of which are hereby incorporated by reference:

U.S. Pat. No. 4,743,022; Wood

U.S. Pat. No. 4,948,134; Suttle et al.

U.S. Pat. No. 5,013,049; Tomaszewski

U.S. Pat. No. 5,100,137; Fulton

U.S. Pat. No. 5,118,109; Gumina

U.S. Pat. No. 5,255,915; Miller

U.S. Pat. No. 5,294,128; Marquez

U.S. Pat. No. 5,314,194; Wolf

U.S. Pat. No. 5,382,025; Sklansky et al.

U.S. Pat. No. 5,407,199; Gumina

U.S. Pat. No. 5,415,404; Joshi et al.

U.S. Pat. No. 5,431,407; Hofberg et al.

U.S. Pat. No. 5,437,451; Fulton

Yet, these attempts suffer from flaws similar to those of traditional poker games. That is, heretofore, the gaming environment has frustrated poker players. Seemingly frequent losing hands, and, in turn, seemingly frequent lost wagers, detract from the optimal gaming environment. Worse still, depending on the type of poker, players have little or no control over the eventual outcome of a hand.

For example, U.S. Pat. No. 5,382,025 discloses a method of playing a variation of poker. A dealer deals three two-card hands face-up. A player selects one of the three hands. The dealer then deals five communal cards face-up. The three hands are then compared, in conjunction with the five communal cards, to determine the winning hand. The two cards from each hand are used along with the best three of the five communal cards for those two cards to achieve the highest poker hand. The player wins if his selected two-card hand is part of the winning poker hand among the three highest poker hands for the respective originally dealt two-card hands. Little or no strategy can be used to win this game because the player must determine, without seeing the subsequently dealt five communal cards, which of three two-card hands will ultimately develop the winning five card hand. Also, no one poker hand has any impact on a subsequent poker hand. Hence, no continuous strategy can be implemented across more than one round.

Accordingly, we have determined that it would be desirable to provide an improved poker game that creates a higher perceived sense of winning than conventional poker games. The player ought to feel that he is winning more often and that the runs of wins are extended relative to conventional poker games. If this can be achieved, the comparative difference in time between subsequent losses and between subsequent wins makes the losses forgettable to the engrossed player. In an optimal gaming environment, such a perceived sense is precisely what should be felt by the player.

Additionally, we have determined that it would be desirable to provide an improved poker game that enables the player to exhibit some control over the eventual outcome of the total payoffs in a round of poker, based on skillful choices of card combinations having payoffs.

SUMMARY OF THE INVENTION

It is a feature and an advantage to the present invention to provide an improved modified poker game that creates a higher perceived sense of winning than conventional poker games.

It is another feature and advantage to the present invention to provide an improved modified poker game that enables the player to exhibit some control over the eventual outcome of the total payoffs in a round of poker, based on skillful and/or risk related choices of payable card combinations in multiple hands in the round.

It is another feature and advantage of the present invention in providing an improved modified card game which may be implemented in a stand-alone environment.

It is another feature and advantage of the present invention in providing an improved modified card game that is exciting and fast to play.

It is another feature and advantage of the present invention in providing a modified card game which provides the player or players the opportunity to increase their winnings. In addition, the present invention optionally and advantageously provides the player with the feature of increasing their winnings with additional risk of loss, including current winnings. Thus, in the present invention, a bonus-like opportunity is provided the player to increase their winnings, making the modified poker game unexpectedly and substantially more exciting than other games.

To achieve the features and advantages of the present invention, an improved video poker apparatus is provided. The apparatus has a display. The invention includes first means for generating a hand including at least five playing cards and for displaying the hand on the display. The invention also includes second means for generating a predetermined number or all payable subsets of the hand and for displaying the payable subsets on the display. A universe of payable subsets includes, in order of increasing amount of payoff, "jacks or better," two pairs, three of a kind, straight, flush, full house, four of a kind, seven card straight, straight flush, seven card flush, royal flush, and seven card straight flush, although any suitable ranking scheme may in fact be used. The apparatus has third means for enabling a user to choose a desired subset from the displayed payable subsets. Fourth means is provided for replacing playing cards in the chosen subset with an equal number of additional playing cards and for displaying the additional playing cards on the display alongside the playing cards not in the chosen subset. The invention also includes fifth means for restarting the first and second means after the subset is chosen, if there is at least one displayed payable subset.

The inventive apparatus preferably includes a slot for accepting a wager and sixth means for selecting among several payoff tables including a first payoff table and a second payoff table. The first payoff table has a higher payoff than the second payoff table for each of the possible payable card combination subsets.

The instant invention may include seventh means for maintaining a total credit tally by summing consecutive payoffs, and for displaying the total credit tally on said display.

The apparatus may have a bus connecting a microprocessor, read only memory, and random access memory. The read only memory may store a computer program for controlling operation of the microprocessor and may include the first, second, third, fourth, and fifth means. The random access memory may include current game data.

The third means may include a left button to programmably move a highlighted region of the display to the left, a right button to programmably move the highlighted region of the display to the right, and a select button to programmably select the highlighted region including a single highlighted subset of the displayed payable subsets. Alternatively, the third means may include a touch-sensitive display so as to permit selection of the desired payable subset by touching the display. Advantageously, according to this alternative, the present invention creates a separate touch-sensitive display button or virtual button corresponding to each of the payable subsets to be displayed.

The criteria for displaying payable subsets for selection by the player or players may include displaying all payable subsets, displaying a predetermined number of best or worst subsets, displaying a predetermined number of randomly selected subsets, and the like. That is, there is no requirement in the present invention that all payable subsets be displayed for selection by the player. Rather, this determination may be game specific, user selectable, or predetermined.

The payoff table, which associates payable card combination subsets to respective payoffs, may be found above the display. Optionally, the read only memory may include the payoff table so that the payoff table can be read therefrom and displayed on the display.

In an another embodiment, computer-executable video poker instructions can be provided in a computer-readable medium. The instructions include the following steps:

(a) initializing a credit tally;

(b) dealing at least five playing cards from the deck(s) of cards to begin a round of video poker;

(c) determining payable subsets of the at least five playing cards;

(d) displaying all of the payable subsets, if the subsets exist;

(e) ending the round of video poker, if the payable subsets do not exist;

(f) prompting a user to choose one of the displayed payable subsets;

(g) determining which of the displayed payable subsets is chosen by the user;

(h) adding a payoff associated with the chosen payable subset to the credit tally;

(i) replacing cards in the chosen payable subset with an equal number of playing cards; and (j) repeating steps (c) through (i).

Seven playing cards may be used to create a poker hand. Alternatively, any number of playing cards may be used to build a poker like hand. For example, four, five six or eight cards may be used in the present invention. The computer-executable instructions may include the steps of determining whether sufficient money has been deposited. Also, the instructions may include associating the deposited money with a respective payoff table from which the payoff for the chosen payable subset is obtained. The respective payoff table may have a universe of payable card combinations including "Jacks or better," two pairs, three of a kind, straight, flush, full house, four of a kind, seven card straight, straight flush, and seven card straight flush, and the like.

The present invention may also be used with designated wild cards in the standard deck of cards, one or more decks of cards having more or less than the number of cards in a standard deck, or additional wild cards as well, such as jokers. In this instance, the potentiality of obtaining even higher card hands, such as five of a kind requires the payoff table to be accommodated therefor.

The inventive instructions may preferably include randomly generating the cards which are initially dealt to the player, and which are subsequently replaced upon selection of player of a payable card hand.

The instructions may include returning the cards in a chosen payable subset to the deck(s), or include removing the cards in the chosen payable subset from the deck(s) for the rest of the round.

The computer-executable instructions may include upgrading the payoff table, upon deposit by the user of additional money, so that the universe of payable card combinations expands to include three pairs, double three of kind, super full house, which is three of a kind and four of a kind, and super royal flush, which is a seven card straight flush with an ace as a highest card. Either or both the super full house and the super royal flush has a payoff including an optional progressive jackpot or bonus. In addition, as indicated above, the present invention optionally uses wild cards to further increase the possibility of obtaining card hands of higher rank, and/or potentially greater or perceived to be greater winnings.

In another embodiment of the instant invention, a method of playing poker includes the following steps:

(a) initializing a credit tally;

(b) dealing at least five playing cards from the deck(s) of cards to begin a round of video poker;

(c) determining payable subsets of the at least five playing cards;

(d) displaying all of the payable subsets, if the subsets exist;

(e) ending the round of video poker, if the payable subsets do not exist;

(f) prompting a user to choose one of the displayed payable subsets;

(g) determining which of the displayed payable subsets is chosen by a user;

(h) adding a payoff associated with the chosen payable subset to the credit tally;

(i) replacing cards in the chosen payable subset with an equal number of playing cards; and (j) repeating steps (c) through (i).

The method may also include the step of determining whether sufficient money has been deposited before proceeding to step (a). Also, the instant method may include associating the deposited money with a respective payoff table from which the payoff for the chosen payable subset is obtained. When seven playing cards are used, the respective payoff table may have a universe of payable card combinations including "Jacks or better," two pairs, three of a kind, straight, flush, full house, four of a kind, seven card straight, straight flush, and seven card straight flush.

The poker playing method may include returning the cards in a chosen payable subset to the deck(s), or include removing the cards in the chosen payable subset from the deck(s) for the rest of the round.

The method may include upgrading the payoff table, upon deposit by the user of additional money, so that the universe of payable card combinations expands to include three pairs, double three of kind, super full house, which is three of a kind and four of a kind, and super royal flush, which is a seven card straight flush with an ace as a highest card. At least one of the super full house and the super royal flush has a payoff including a progressive jackpot.

Alternatively, the invention can include a video poker apparatus. The apparatus may have a display including a generated hand of poker and a plurality of buttons for enabling a user to select a winning subset of the generated hand of poker. The display may include generated replacement playing cards only for playing cards in the winning subset. The apparatus may be implemented using a standard personal computer, in a standard stand-alone environment or in a standard networked environment.

In another embodiment, the invention can include a method of playing poker having the following steps of:

(a) playing a winning subset of a poker hand, unless no winning subset thereof exists;

(b) replacing playing cards in the winning subset of the hand with an equal number of new playing cards; and (c) repeating steps (a) and (b).

BEST MODE FOR CARRYING OUT THE INVENTION

The following describes the basic components and rules for playing the extended play video poker game.

Figure 1:
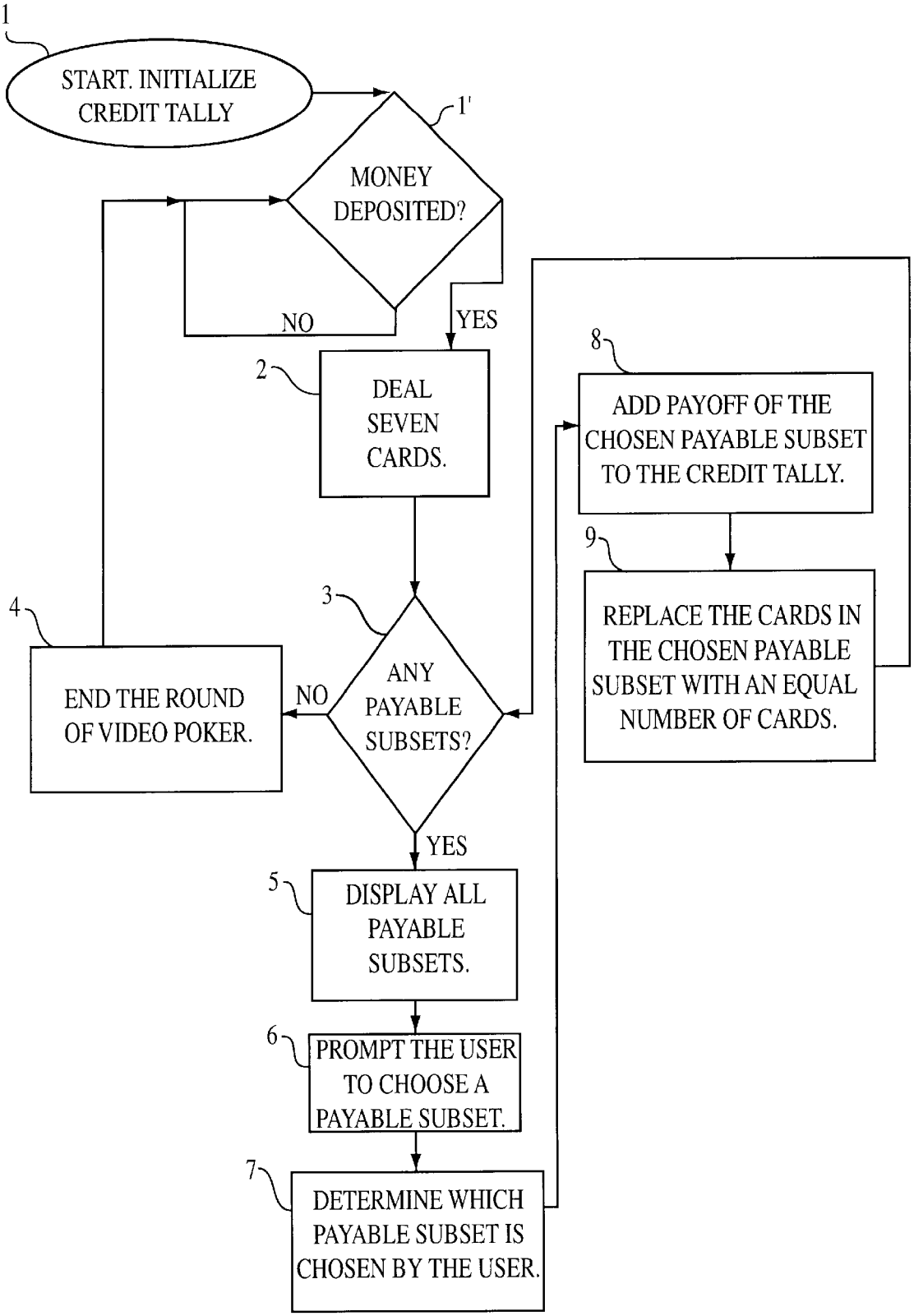
FIG. 1 shows a flowchart of the video poker game.

General Rules:

FIG. 1 shows a flowchart of the video poker game, wherein the reference numerals correspond to the following step numerals.

Step 1. The video poker apparatus initializes a credit tally, which tracks the total winnings of a player.

(Step 1' is preferred, though not mandatory, and will be discussed below).

Step 2. The apparatus deals a hand of playing cards to a player to start a round of video poker.

Step 3. The apparatus determines all the possible winning hands based on the dealt hand.

Step 4. The apparatus ends the round, if no possible winnings hands exist.

Step 5. The apparatus displays all possible winning hands beneath the hand.

Step 6. If winning hands do exist, the player is prompted to choose one of the displayed winning hands.

Step 7. The apparatus determines which of the displayed winning hands was chosen. Since there is no penalty for allowing the player to select a payable hand for additional replacement cards, it is generally assumed that the player will select one of the sets of payable hands to be cashed-in, and have the corresponding cards replaced. On the other hand, in accordance with another embodiment of the invention, the modified poker game may impose a penalty for cashing in a payable subset hand when the player elects to replace those cards. Such penalty may be in the form of a reduced payoff table, an additional wager or ante to replace the cards that have been cashed-in, and the like.

In the event that all cards may be selected for a payable subset, the player will be rewarded, and the game will terminate. Alternatively, the player may be awarded a free ante for the next game when all cards are replaced as a result of all displayed cards being selectable as a payable subset.

Step 8. The apparatus adds a payoff associated with the chosen winning hand to the credit tally.

Step 9. The apparatus then replaces those cards in the chosen winning hand or payable/cashable hand with an equal number of newly dealt cards.

Step 10. The player continues play so that the apparatus and the player together repeat Steps 3 through 9.

Number of players:

In the preferred embodiment, one player is intended to play video poker at the video poker apparatus at a time, although it is possible to play against a dealer, house or with multiple players against each other as well, in a table-like card game or in a networked environment. In addition, while the above discussion has involved the inputting of wagers into the video machine, the modified poker game may be played without the use of wagers, in a video or card game style as well.

EXAMPLE 1

The discussion regarding Example 1 will refer to FIGS. 2 through 5.

Figure 2:
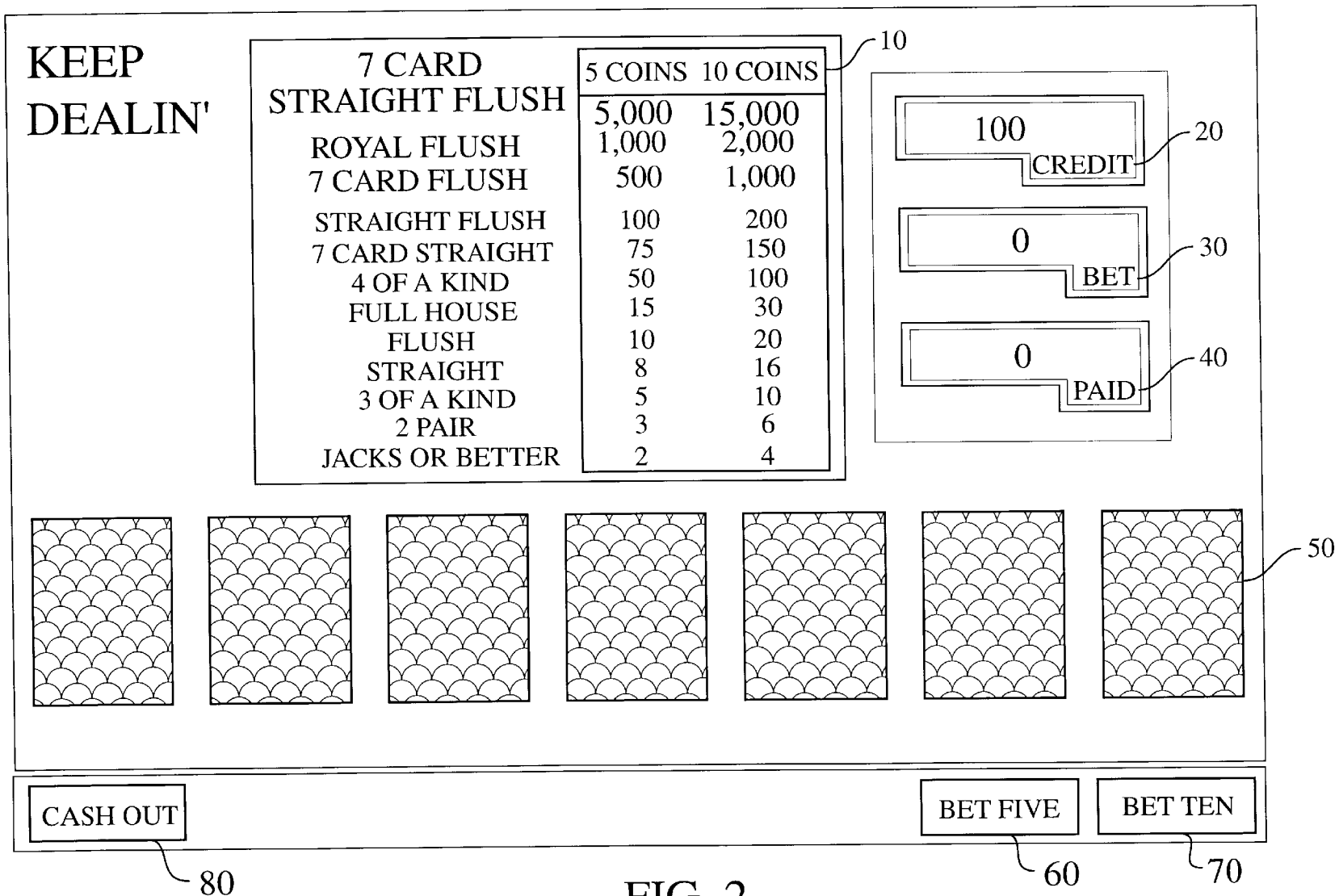
FIG. 2 shows a sample initial screen display prior to a first round of video poker.

FIG. 2 shows an initial screen display of a preferred embodiment. At the start of the video poker game, the apparatus displays two payoff tables 10. A payoff table determines the payoff associated with a winning hand of poker. At the outset of a round of poker, the player may select a "5 Coins" payoff table or a "10 Coins" payoff table, where "5 Coins" and "10 Coins" represent the required wager for a round of the modified poker game using the respective payoff table. Thus, in a preferred embodiment, prior to dealing an initial hand of playing cards, as indicated at Step 1' in FIG. 1, the apparatus waits for an appropriate wager to be deposited, i.e., five coins to select the "5 Coins" payoff table, and 10 coins to select the "10 Coins" payoff table. Other denominations may also be used in the present invention, and the illustration and description of the 5 and 10 coin payoff table is exemplary.

The apparatus also displays a Credit tally 20 reflecting a player's total winnings, a Bet amount 30 reflecting the deposited wager, and a Paid amount 40 reflecting the payoff for a winning hand. Note that before the start of a new game, the Credit tally 20 may show a previous player's score, as in FIG. 2, to entice a subsequent player to attempt to beat that score. The apparatus further displays a "Bet Five" button 60 and a "Bet Ten" button 70 to enable the player to select "Bet Five" for the "5 Coins" payoff table, or "Bet Ten" for the "10 Coins" payoff table.

The player is to insert five coins or ten coins and then select either the "Bet Five" button or the "Bet Ten" button, as appropriate, or vice versa.

Figure 3:
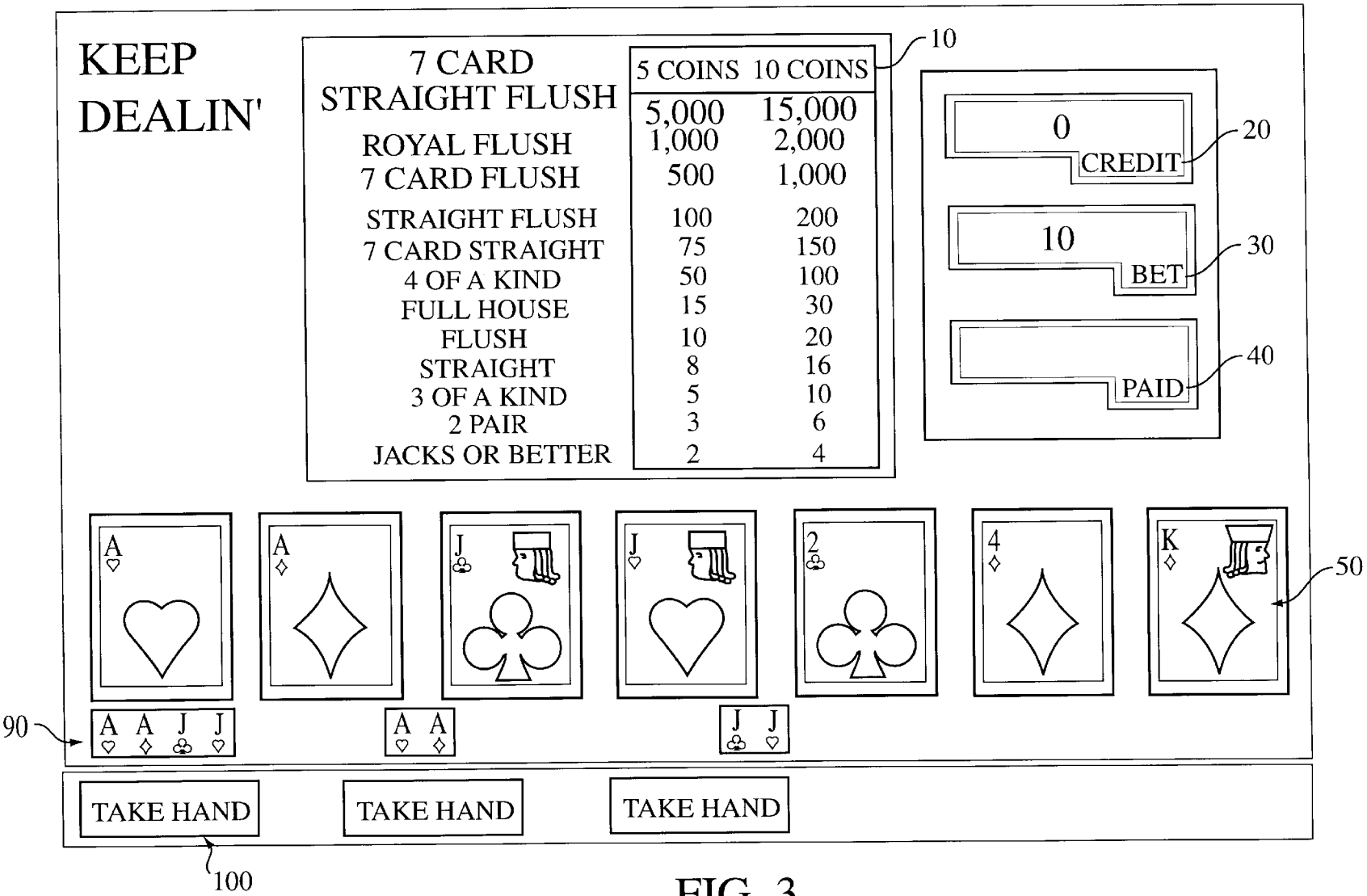
FIG. 3 shows a sample first screen display in a hypothetical round of video poker.
Figure 4:
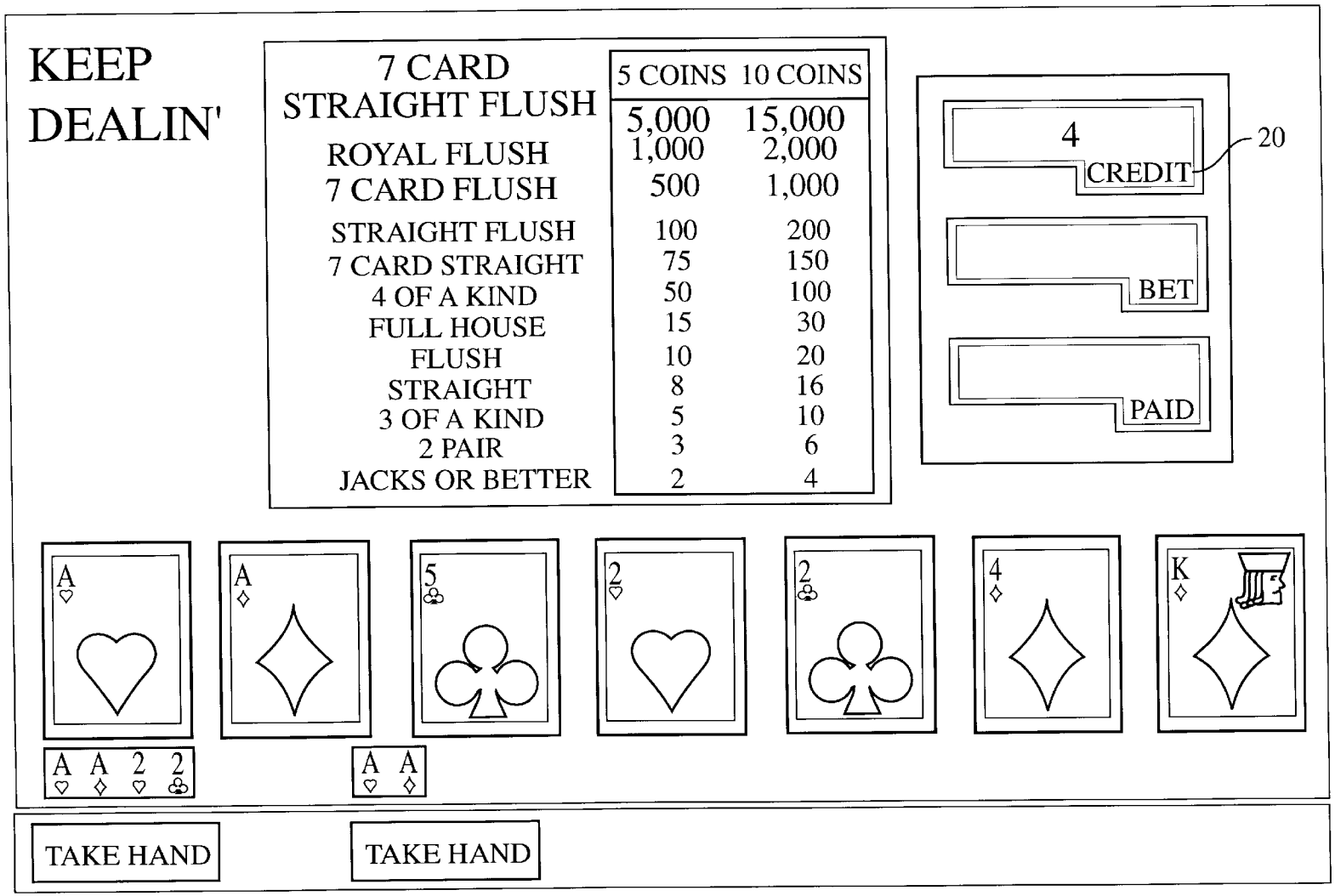
FIG. 4 shows a sample second screen display in a hypothetical round of video poker.
Figure 5:
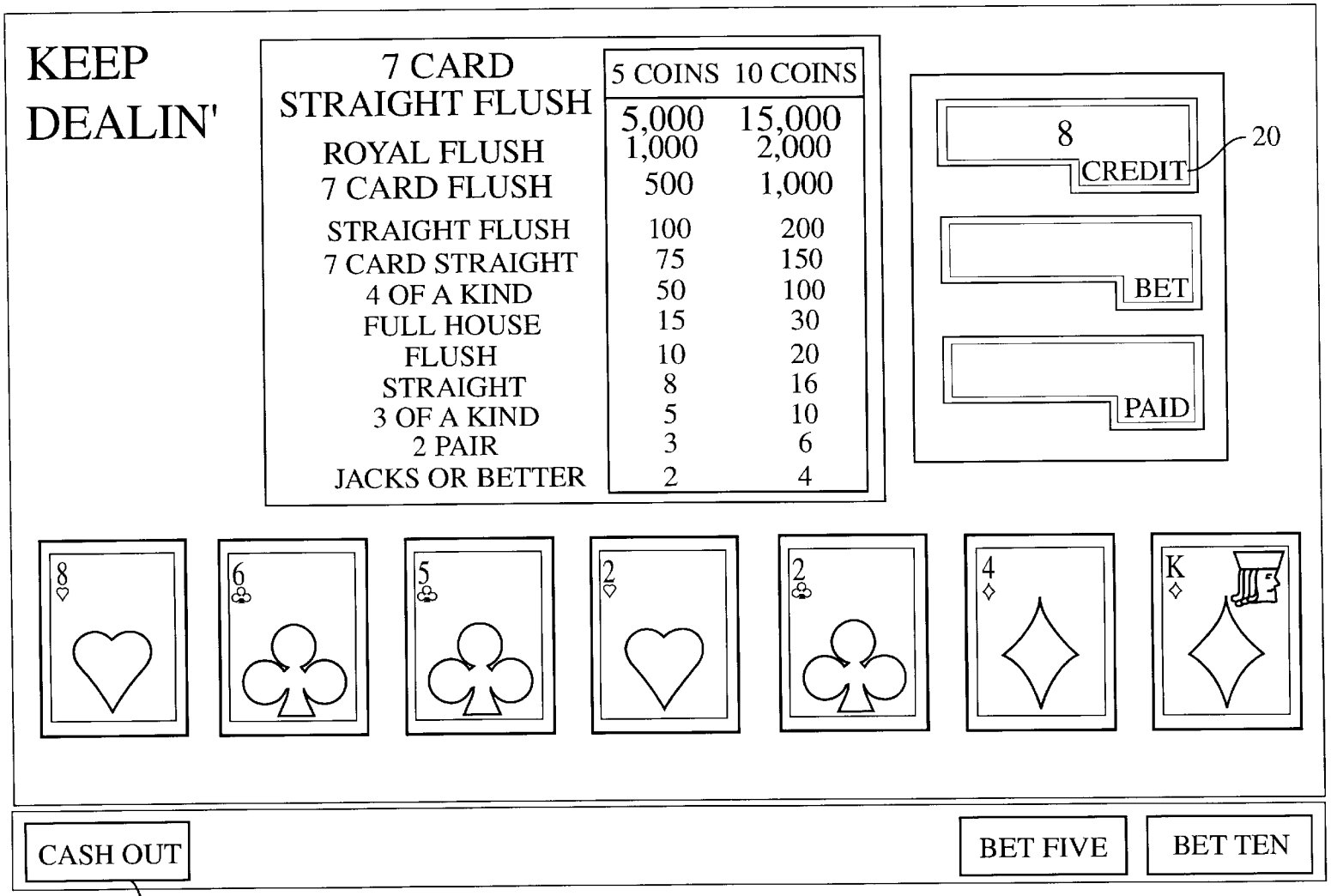
FIG. 5 shows a sample final screen display in a hypothetical round of video poker.

FIGS. 3 through 5 illustrate sample display screens of a round of video poker, according to the instant invention. For purposes of the discussion of FIGS. 3 through 5, it will be assumed that the player deposits a ten coin wager and selects the "Bet Ten" button.

A hand 50 of seven cards is dealt and displayed. In FIG. 3, an ace of hearts, an ace of diamonds, a jack of clubs, a jack of hearts, a two of clubs, a four of diamonds, and a king of diamonds are shown as the first hand. Beneath the hand 50 are displayed all possible payable subsets 90 of the hand, according to the payoff tables 10. As described above, other predetermined criteria may be used as to the display of selected payable subsets 90. In addition, in accordance with another embodiment fo the invention, the player may be forced to select a predetermined payable subset based on predetermined criteria, such as best payable subset, highest ranking payable subset, lowest ranking payable subset, and the like.

For the hand 50 in FIG. 3, three payable subsets 90 are displayed. The payable subsets are a two pair consisting of a pair of aces and a pair of jacks; a "jacks or better" consisting of a pair of aces; and another "jacks or better" consisting of a pair of jacks.

According to the payoff tables 10, if five coins were wagered, the payable subset of a two pair has a payoff of three coins, whereas if ten coins were wagered, the two pair has a payoff of six coins. Likewise, if five coins were wagered, either payable subset of "jacks or better" has a payoff of two coins, whereas if ten coins were wagered, either payable subset of "jacks or better" has a payoff of four coins. Because the player selected the "Bet Ten" button, he opted for the "10 Coins" payoff table, and thus, the above-mentioned "10 Coins" payoffs are pertinent, in this case.

Beneath each of the payable subsets 90 is a "Take Hand" button 100. To choose a desired winning hand, the player must select the "Take Hand" button 100 beneath it. For example, if the player were to select the "Take Hand" button 100 beneath the pair of jacks, his Credit tally 20 would be credited with the associated four coin payoff, as shown in FIG. 4.

Note that, the player need not deposit an additional wager to continue playing the present round. As described above, however, in accordance with another embodiment of the invention, an additional wager may be used or a reduced payoff table, to allow the player to cash in a payable subset.

As can be seen in FIG. 4, the pair of jacks chosen as the payable subset have been replaced with a five of clubs and a two of hearts in the displayed hand 50. Again, all of the possible payable subsets 90 are displayed below the hand 50. This time, the payable subsets include a two pair consisting of two aces and two twos; and a "jacks or better" consisting of a pair of aces. The "10 Coins" payoff table is still applicable. Thus, the payable subset 90 of the two pair has a six coin payoff, and the payable subset 90 of the "jacks or better" has a four coin payoff.

Continuing the example, if the player were to select the "Take Hand" button 100 beneath the payable subset 90 of the pair of aces, his Credit tally 20 would be credited four coins, as shown in FIG. 5.

Note that, again, the player need not deposit an additional wager to continue playing the present round.

As can be seen in FIG. 5, the pair of aces chosen as the payable subset have been replaced with an eight of hearts and a six of clubs in the displayed hand 50. Also, the Credit tally 20 reflects eight coins worth of total winnings. This time, however, no payable subsets are displayed because no payable subsets of the hand 50 exist, thereby ending the present round of video poker.

The player has two options. First, he may select the "Cash Out" button to receive his total winnings as represented in the Credit tally 20. Second, he may select the "Bet Five" button or the "Bet Ten" button to play another round of video poker.

EXAMPLE 2

Example 2 will illustrate a possible strategy when playing the present video poker game. The discussion of Example 2 will refer to FIGS. 6 through 8. It will be assumed that the player has chosen the "10 Coins" payoff table and deposited the appropriate ten coin wager.

Figure 6:
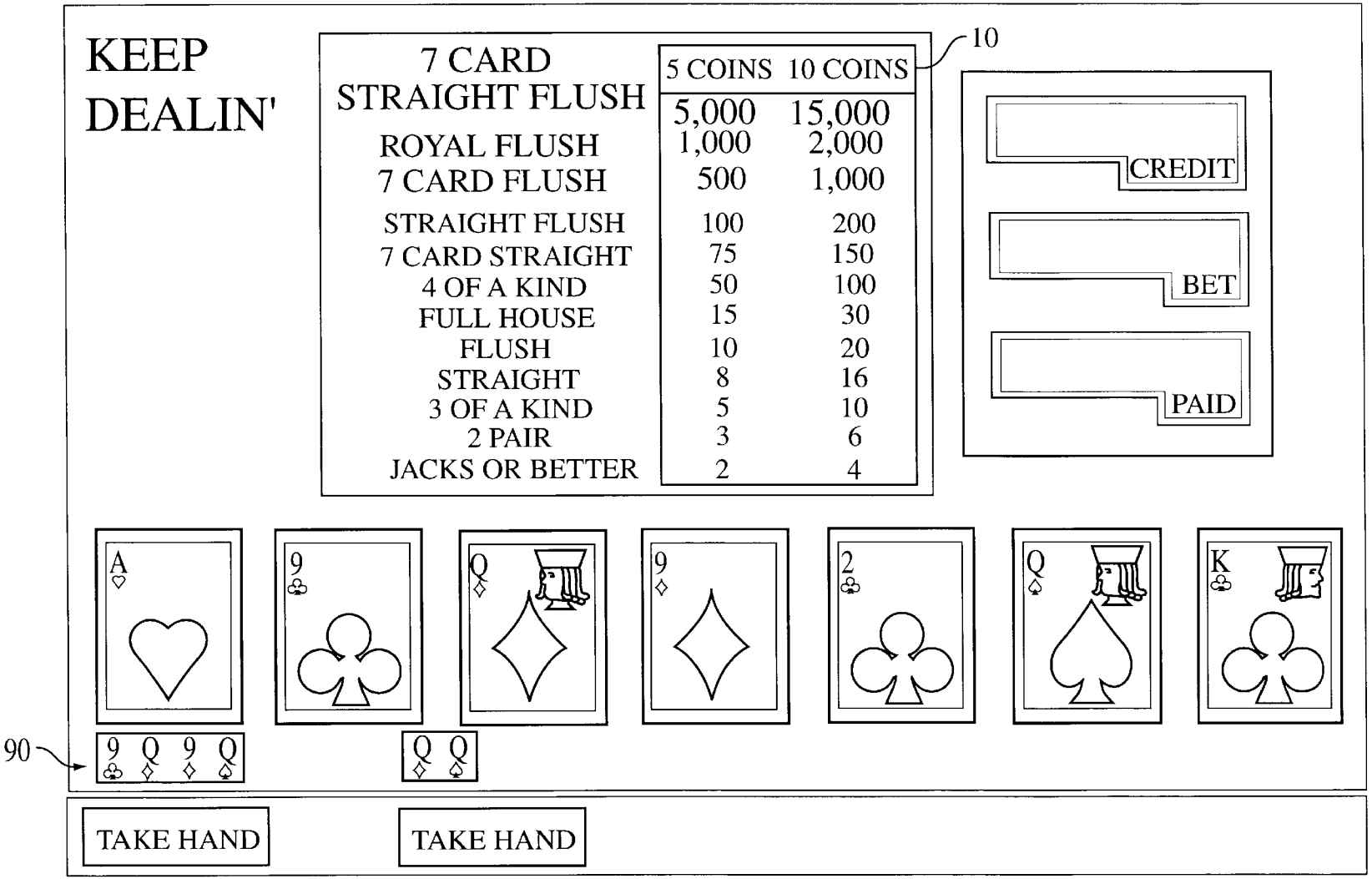
FIG. 6 shows a sample screen display in a hypothetical round of video poker.

FIG. 6 shows a sample hand 50 of playing cards consisting of an ace of hearts, a nine of clubs, a queen of diamonds, a nine of diamonds, a two of clubs, a queen of spades, and a king of clubs. The possible payable subsets 90 are displayed beneath the hand 50. The payable subsets 90 include a two pair consisting of a nine of clubs, a queen of diamonds, a nine of diamonds, and a queen of spades; and a "jacks or better" consisting of a queen of diamonds and a queen of spades.

Referring to the payoff table 10 for "10 Coins," the two pair has a payoff of six coins, whereas the "jacks or better" has a payoff of four coins. Clearly, the two pair has a higher payoff than the "jacks or better." A conservative player may opt for the two pair.

Figure 7:
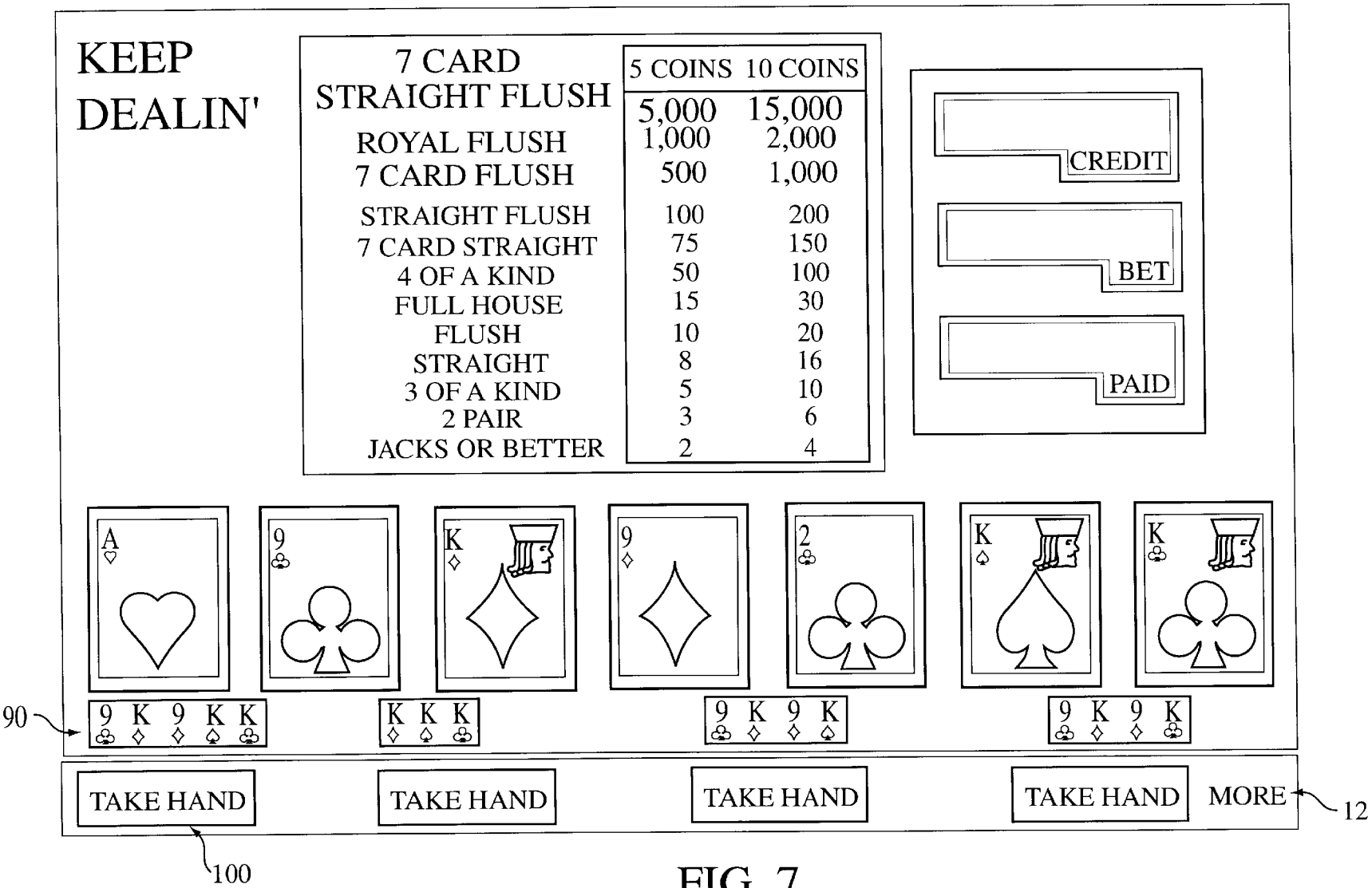
FIG. 7 shows a sample screen display in a hypothetical round of video poker.
Figure 8:
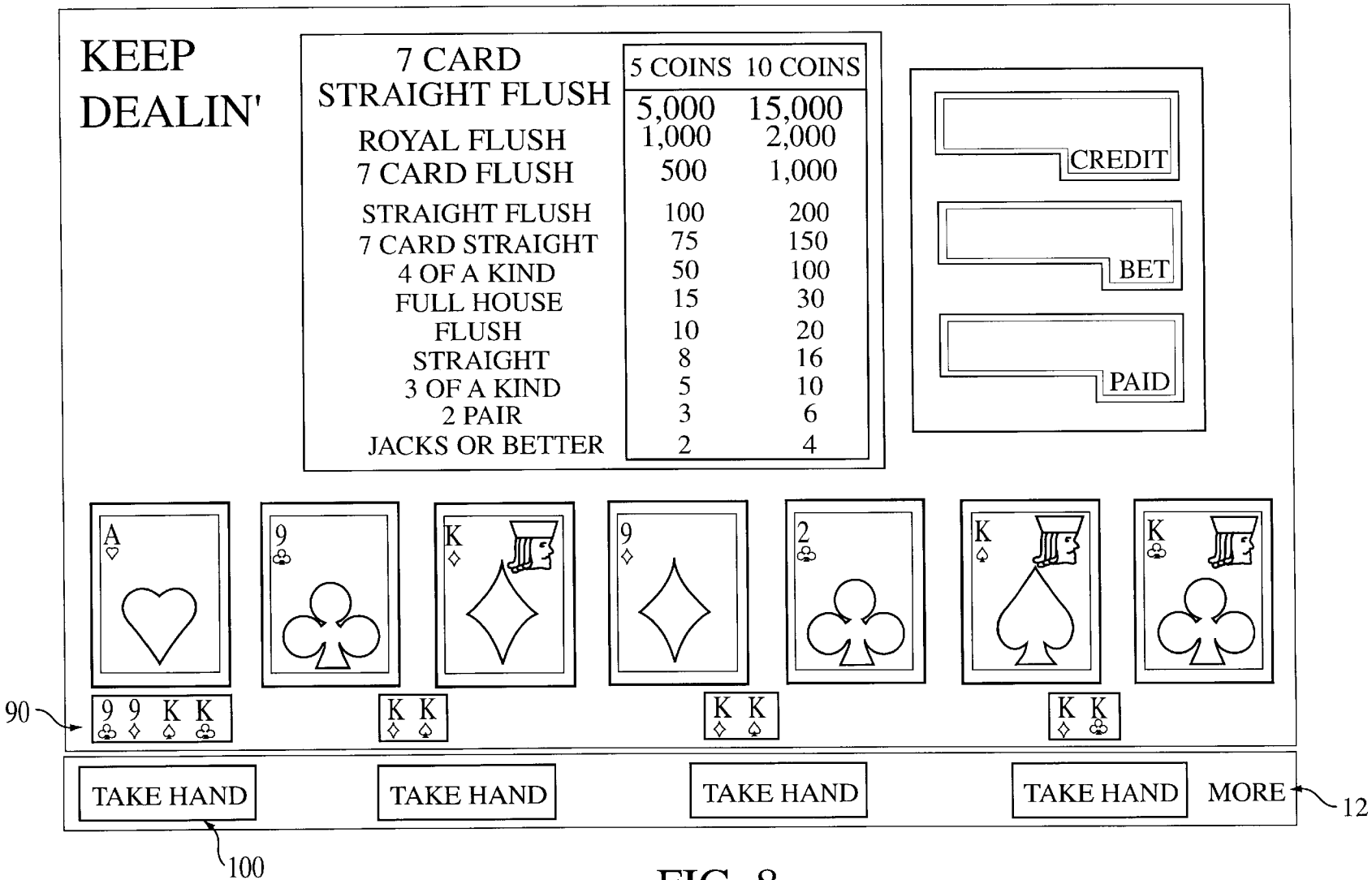
FIG. 8 shows a sample screen display in a hypothetical round of video poker.

A player with a strategic mind and a higher risk tolerance may opt for the "jacks or better." Such a player would receive a payoff of only four coins. Continuing though, FIGS. 7 and 8 show a possible subsequent hand 50. That is, the queen of diamonds and the queen of spades of the chosen "jacks or better" payable subset have been replaced with a king of diamonds and a king of spades.

The payable subsets 90 of this subsequent hand 50 are provided below the hand. Note that one of the payable subsets 90 is a fill house consisting of a nine of clubs, a king of diamonds, a nine of diamonds, a king of spades, and a king of clubs. Referring to the payoff table 10 for "10 Coins," a full house has a payoff of 30 coins. It is quite possible that such an opportunity for a high payoff would not have availed itself, if, in the previous hand, the player had opted for the two pair, instead of the "jacks or better."

EXAMPLE 3

As illustrated above in FIGS. 7 and 8 of Example 2, it is conceivable for there to be more payable subsets for a given hand than is possible to view on a display at a given time. The present invention can use two or more screens to display all of the possible payable subsets.

FIG. 7 shows a displayed hand 50 including an ace of hearts, a nine of clubs, a king of diamonds, a nine of diamonds, a two of clubs, a king of spades, and a king of clubs. In FIG. 7, the payable subsets 90 below the displayed hand 50 include a fill house consisting of a nine of clubs, a king of diamonds, a nine of diamonds, a king of spades, and a king of clubs; a three of a kind consisting of a king of diamonds, a king of spades, and a king of clubs; and a two pair consisting of a nine of clubs, a king of diamonds, a nine of diamonds, and a king of spades.

Note that adjacent the "Take Hand" button for the above-mentioned two pair is a "More" button.

If the player selects the "More" button, the display shows a subsequent screen, as in FIG. 8. The hand 50 in FIG. 8 is, of course, the same as the one shown in FIG. 7. However, there are additional payable subsets 90, which were not shown among the payable subsets in FIG. 7. Specifically, the additional payable subsets 90 include a two pair consisting of a nine of clubs, a nine of diamonds, a king of spades, and a king of clubs; a "jacks or better" consisting of a king of diamonds and a king of spades; a "jacks or better" consisting of a king of diamonds or a king of clubs; and a "jacks or better" consisting of a king of spades and a king of clubs.

To return the previous screen, the player may select the "More" button 120.

Figure 9:
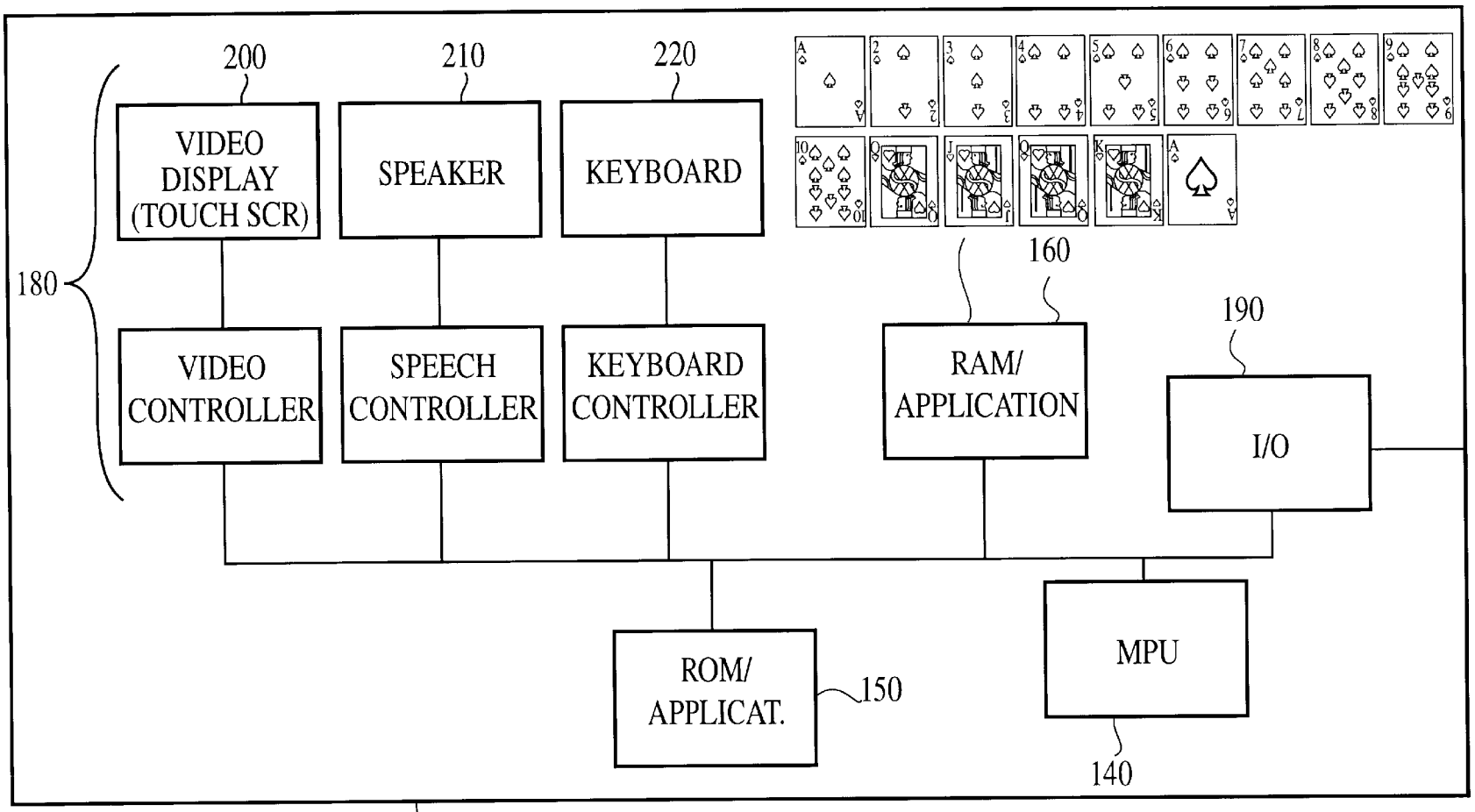
FIG. 9 shows a schematic representation of the computer hardware of the instant invention.

Physical Components:

Referring to FIG. 9, the instant video poker apparatus can be implemented with the computer hardware 130.

The computer hardware 130 may include a microprocessor (MPU) 140, which executes the computer-implemented functions for the present video poker game system. Hardware 130 may include read only memory (ROM) 150 for storing, among other things, the video poker game instructions. A sample software program that implements the video poker game according to the instant invention is included in the Appendix provided below. The computer hardware 130 also may include random access memory (RAM) 160 for, among other things, retrieving the video poker game instructions stored in ROM 150 and for storing the instructions for execution by the microprocessor of a video poker game.

Figure 10:
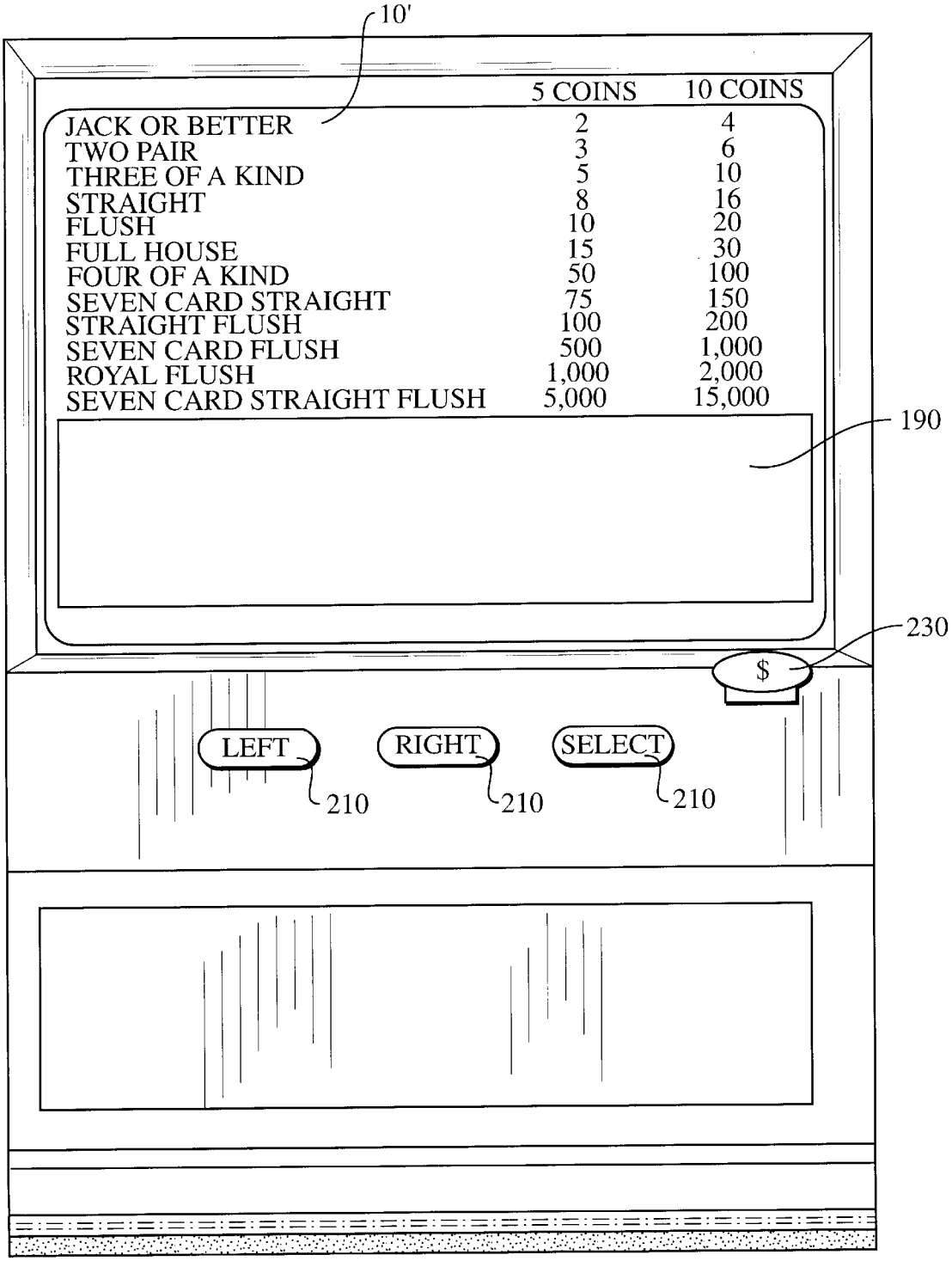
FIG. 10 shows an alternate embodiment of the instant invention.

Referring to FIGS. 9 and 10, the computer hardware 130 may include user interface devices 180, which may include a video display 200, a speaker 210, and/or a keyboard 220. Each of these user interface devices may include respective controllers for controlling transmission of the required data for properly utilizing the user interface devices. The video display 200 may include a gray scale video monitor or a color video monitor.

The keyboard 220 may either have a "Left" button, a "Right" button, and a "Select" button, as shown in FIG. 10, or have, for example, five buttons. Other number of buttons may also be used. Alternatively, as described above, a touch screen monitor may be used where a separate button is designated for each payable subset card hand.

If the three button keyboard 220 is implemented, the "Left" and "Right" buttons may be manipulated, repeatedly if needed, to move a highlighted portion of the video display to a desired payable subset or the "Take Hand" button beneath it. The "Select" button can then be manipulated to choose the desired payable subset, thereby crediting the Credit tally 20 with the payoff associated with the desired payable subset and causing the instant apparatus to replace the cards in the chosen payable subset with an equal number of new cards.

The computer hardware 130 may also include an input/output device 190 providing a gateway from the hardware 130 to possible external devices. For example, input/output device 190 may connect to other video poker apparatuses for raising a progressive jackpot.

The video poker game apparatus may also include a slot 230 for accepting a wager, as shown in FIG. 10.

The preferred payoff tables are as follows:

| PAYABLE SUBSET | 5 COINS | 10 COINS |
|---|---|---|
| Jacks or better | 2 | 4 |
| Two pair | 3 | 6 |
| Three of a kind | 5 | 10 |
| Straight | 8 | 16 |
| Flush | 10 | 20 |
| Full House | 15 | 30 |
| Four of a kind | 50 | 100 |
| Seven card straight | 75 | 150 |
| Straight flush | 100 | 200 |
| Seven card flush | 500 | 100 |
| Royal flush | 1,000 | 2,000 |
| Seven card straight flush | 5,000 | 15,000 |

Advantageously, the present invention includes an additional bonus reward, e.g., 15,000, for input of 10 coins and a seven card straight flush. Other standard payoff tables may also be used.

Variations:

The number of cards dealt to form a hand can be any number of cards, from, for example, four to seven, eight, nine and the like.

The video display 190 may be touch sensitive so as to obviate the need for the keyboard 220. That is, referring to FIG. 3, for example, a payable subset 90 could be selected by touching, on the touch-sensitive video display 190, the desired payable subset, or the "Take Hand" button beneath the desired payable subset.

As shown in FIG. 10, the payoff tables 10' may alternatively be affixed to a decorative portion of the video poker game apparatus above the video display 190.

The universe of payable subsets may be expanded to include three pair, double three of a kinds, super full house (four of a kind and three of a kind), and super royal flush (seven card royal flush). Because the latter two payable subsets are likely to occur so infrequently, it may be preferable to have a progressive jackpot payoff associated therewith. This expanded universe of payable subsets may be available to the player upon deposit of an extra wager, for example, an extra coin.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A video poker apparatus comprising:

a display;

first means for generating a hand including at least five playing cards and for displaying the hand on said display;

second means for generating all payable subsets of the hand and for displaying the payable subsets on said display, a universe of payable subsets including, in order of increasing amount of payoff, "Jacks or better," two pairs, three of a kind, straight, flush, full house, four of a kind, seven card straight, straight flush, seven card flush, royal flush, and seven card straight flush;

third means for enabling a user to select a desired subset from the displayed payable subsets;

fourth means for replacing playing cards in the desired subset with an equal number of additional playing cards and for displaying the additional playing cards on said display alongside the playing cards not in the desired subset; and fifth means for restarting said first and second means after the desired subset is chosen, if a number of displayed payable subsets is at least one.

2. The video poker apparatus according to claim 1, further comprising:

a slot for accepting a wager;

sixth means for selecting one of a plurality of payoff tables including a first payoff table and a second payoff table, the first payoff table requiring a higher wager than the second payoff table, the first payoff table having a higher payoff than the second payoff table for each of the payable subsets.

3. The video poker apparatus according to claim 2, further comprising:

seventh means for maintaining a total credit tally by summing consecutive payoffs, and for displaying the total credit tally on said display.

4. The video poker apparatus according to claim 1, further comprising:

a microprocessor:

a read only memory storing a computer program for controlling operation of said microprocessor, said computer program including said first, second, third, fourth, and fifth means;

a random access memory storing current game data; and a bus connecting said microprocessor, said read only memory, said random access memory, and said display.

5. The video poker apparatus according to claim 4, wherein said third means include a left button to programmably move a highlighted region of said display left, a right button to programmably move the highlighted region of said display right, and a select button to programmably select the highlighted region, the highlighted region including a highlighted subset of the displayed payable subsets.

6. The video poker apparatus according to claim 4, wherein said third means includes said display, said display being touch-sensitive so as to permit selection of the desired subset by touching said display.

7. The video poker apparatus according to claim 1, further comprising at least one payoff table located above said display, said payoff table associating each of a plurality of payable card combinations with a respective payoff.

8. The video poker apparatus according claim 4, wherein said read only memory includes at least one payoff table for appearing on said display, the at least one payoff table associating each of a plurality of card combinations with a respective payoff.

9. A computer-readable medium, storing video poker instructions being executable by a computer, said video poker instructions comprising:

(a) initializing a credit tally;

(b) dealing at least five playing cards from at least one deck of cards to begin a round of video poker:

(c) determining payable subsets of the at least five playing cards;

(d) ending the round of video poker, when the payable subsets do not exist;

(e) displaying all of the payable subsets, when the payable subsets exist;

(f) prompting a user to choose one of the displayed payable subsets;

(g) determining which of the displayed payable subsets is chosen by the user;

(h) adding a payoff associated with the chosen payable subset to the credit tally;

(i) replacing only cards in the chosen payable subset with an equal number of playing cards; and (j) repeating steps (c) through (i).

10. The computer-readable medium according to claim 9, wherein the at least five playing cards is seven playing cards, said instructions further comprising:

determining whether a sufficient wager has been deposited before proceeding to step (a); and associating the deposited wager with a respective payoff table from which the payoff for the chosen payable subset is obtained, the respective payoff table having a universe of payable card combinations including "Jacks or better," two pairs, three of a kind, straight, flush, full house, four of a kind, seven card straight, straight flush, royal flush, and seven card straight flush.

11. The video poker instructions according to claim 9, further comprising:

randomly generating the cards used in said card-dealing step (b) and said card-replacing step (i).

12. The video poker instructions according to claim 9, further comprising:

returning the cards in the chosen payable subset to the at least one deck during any remaining duration of the round.

13. The video poker instructions according to claim 9, further comprising:

removing the cards in the chosen payable subset from the at least one deck for any remaining duration of the round.

14. The video poker instructions according to claim 10, further comprising:

upgrading the payoff table, upon deposit by the user of an additional wager, so that the universe further includes at least one of three pairs, double three of a kind, super full house including three of a kind and four of a kind, and super royal flush including a seven card straight flush with an ace as a highest card, wherein at least one of the super full house and the super royal flush has a payoff including at least one of a progressive jackpot and a bonus.

15. A method of playing poker, comprising the steps of:

(a) initializing a credit tally;

(b) dealing at least four playing cards from at least one deck of cards to begin a round of video poker:

(c) determining payable subsets of the at least four playing cards;

(d) ending the round of video poker, when the payable subsets do not exist;

(e) displaying all of the payable subsets, when the payable subsets exist;

(f) prompting a user to choose one of the displayed payable subsets;

(g) determining which of the displayed payable subsets is chosen by the user;

(h) adding a payoff associated with the chosen payable subset to the credit tally;

(i) replacing only cards in the chosen payable subset with an equal number of playing cards; and (j) repeating steps (c) through (i).

16. The method according to claim 15, wherein the at least four playing cards comprises seven playing cards, said method further comprising the steps of:

determining whether a sufficient wager has been deposited before proceeding to said step (a); and associating the deposited wager with a respective payoff table from which the payoff for the chosen payable subset is obtained, the respective payoff table having a universe of payable card combinations including "Jacks or better," two pairs, three of a kind, straight, flush, full house, four of a kind, seven card straight, straight flush, seven card flush, royal flush, and seven card straight flush.

17. The method according to claim 15, further comprising the step of:

randomly generating the cards used in said card-dealing step (b) and said card-replacing step (i).

18. The method according to claim 15, further comprising the step of:

returning the cards in the chosen payable subset to the at least one deck.

19. The method according to claim 15, further comprising the step of:

removing the cards in the chosen payable subset from the at least one deck for any remaining duration of the round.

20. The method according to claim 16, further comprising a step of:

upgrading the payoff table, upon deposit by the user of an additional wager, so that the universe further includes at least one of three pairs, double three of a kind, super full house including three of a kind and four of a kind, and super royal flush including a seven card straight flush with an ace as a highest card, wherein at least one of the super full house and the super royal flush has a payoff including a progressive jackpot.

21. A modified poker apparatus implementing modified poker, comprising:

a display including a generated hand of poker; and a plurality of buttons for enabling a user to select a winning subset of the generated hand of modified poker, a data processor, operatively connected to said display and said plurality of buttons, generating the generated hand of poker for display on said display, receiving the winning subset from one of said plurality of buttons when selected by the user, and generating replacement playing cards only for playing cards in the winning subset to obtain a final generated hand of the modified poker.

22. A method of playing a modified poker game wherein a first predetermined number of playing cards are dealt from at least one deck of cards, comprising the steps of:

(a) determining payable subsets of the first predetermined number of playing cards in accordance with first predetermined criteria;

(b) displaying a second predetermined number of the payable subsets to be selected by a player in accordance with second predetermined criteria;

(c) replacing only cards in the payable subset selected in said step (b) with playing cards; and (d) repeating steps (a) through (c) until no payable subsets exist.

23. A method according to claim 22, wherein the second predetermined criteria includes one of all payable subsets, highest ranking payable subsets, lowest ranking payable subsets, and random payable subsets.

24. A method according to claim 22, wherein the first predetermined criteria includes a payoff table.

25. A method of playing a modified poker game wherein a first predetermined number of playing cards are dealt from at least one deck of cards, comprising the steps of:

(a) determining payable subsets of the first predetermined number of playing cards in accordance with first predetermined criteria;

(b) displaying a second predetermined number of the payable subsets to be selected by a player in accordance with second predetermined criteria;

(c) awarding the player responsive to the payable subset selected in said step (b) and in accordance with the first predetermined criteria;

(d) replacing only cards in the payable subset selected in said step (b) with playing cards; and (e) repeating steps (a) through (d) until no payable subsets exist.

26. A method according to claim 25, wherein the second predetermined criteria includes one of all payable subsets, highest ranking payable subsets, lowest ranking payable subsets, and random payable subsets.

27. A method according to claim 25, wherein the first predetermined criteria includes a payoff table.

28. A method according to claim 25, wherein said method requires the player to input a first wager, and said replacing step (d) requires the player to input a second wager.

29. A method according to claim 25, wherein said method requires the player to input a wager, and said replacing step (d) does not require the player to provide any additional wager.

30. A method of playing a modified poker game, comprising the steps of:

(a) dealing by a dealer a first predetermined number of playing cards from at least one deck of cards;

(b) determining by the dealer payable subsets of the first predetermined number of playing cards in accordance with first predetermined criteria;

(c) displaying by the dealer a second predetermined number of the payable subsets to be selected by a player in accordance with second predetermined criteria; (d) selecting by the player a payable subset of the second predetermined number of the payable subsets in accordance with the second predetermined criteria;

(e) replacing by the dealer only cards in the payable subset selected in step (d) with playing cards; and (f) repeating steps (a) through (e) until no payable subsets exist by the dealer and the player.

31. A computer-implemented method of playing a modified poker game, comprising the steps of:

(a) dealing by a computer a first predetermined number of playing cards from at least one deck of cards;

(b) determining by the computer payable subsets of the first predetermined number of playing cards in accordance with first predetermined criteria;

(c) displaying by the computer a second predetermined number of the payable subsets to be selected by a player in accordance with second predetermined criteria;

(d) selecting by the player a payable subset of the second predetermined number of the payable subsets in accordance with the second predetermined criteria;

(e) replacing by the computer only cards in the payable subset selected in step (d) with playing cards; and (f) repeating steps (a) through (e) until no payable subsets exist by the computer and the player.

* * * * *